US005264994A

United States Patent [19]

Choi

[11] Patent Number: 5,264,994

[45] Date of Patent: Nov. 23, 1993

[54] RECESSED ILLUMINATING APPARATUS

[76] Inventor: Yoong J. Choi, #2193 Sinyang-Ri, Jooduck-Myon, Joongwon-Koon, Choongcheongbook-Do, Rep. of Korea

[21] Appl. No.: 829,466

[22] Filed: Jan. 31, 1992

[30] Foreign Application Priority Data

Apr. 1, 1991 [KR] Rep. of Korea ..... 1991-4481

[51] Int. Cl.[5] ..... F21S 3/02

[52] U.S. Cl. ..... 362/148; 362/304; 362/346; 362/348; 362/365

[58] Field of Search ..... 362/147, 148, 346, 347, 362/364, 365, 404, 297, 298, 302, 304, 348

[56] References Cited

U.S. PATENT DOCUMENTS

| | | | |
|---|---|---|---|
| 3,283,142 | 11/1966 | Freeman | 362/298 |
| 3,748,460 | 7/1973 | Price | 362/365 |
| 4,293,895 | 10/1981 | Kristofek | 362/147 |
| 4,439,816 | 3/1984 | Litchfield | 362/346 |
| 4,475,147 | 10/1984 | Kristofek | 362/147 |
| 4,564,888 | 1/1986 | Lewin et al. | 362/147 |
| 4,907,143 | 3/1990 | Lasker | 362/346 |
| 4,947,297 | 8/1990 | Druffel et al. | 362/147 |
| 5,068,772 | 11/1991 | Shapiro et al. | 362/147 |

FOREIGN PATENT DOCUMENTS

| | | | |
|---|---|---|---|
| 0249102 | 1/1964 | Australia | 362/365 |
| 0120984 | 9/1979 | Japan | 362/147 |
| 63-29362 | 6/1980 | Japan . | |
| 1-43964 | 9/1989 | Japan . | |
| 7704232 | 10/1978 | Netherlands | 362/147 |
| 0811148 | 4/1959 | United Kingdom | 362/364 |

*Primary Examiner*—Albert J. Makay
*Assistant Examiner*—Alan B. Cariaso
*Attorney, Agent, or Firm*—Flynn, Thiel, Boutell & Tanis

[57] ABSTRACT

A recessed illuminating apparatus has a fluorescent lamp horizontally arranged in a cylindrical body, a first reflecting plate having a wave shape is mounted on the body, and a second reflecting plate is mounted by a plurality of supporting members in an open portion at the lower portion of the body, whereby the reflecting efficiency is effectively increased. A plurality of sliding holes are formed in the side wall of the body, and a respective fastening member is inserted into each sliding hole and secures the body when the body is inserted into a recessed hole in a ceiling.

9 Claims, 5 Drawing Sheets

RECESSED ILLUMINATING APPARATUS

FIELD OF THE INVENTION

The present invention relates generally to a recessed illuminating apparatus and, more specifically, to a recessed illuminating apparatus in which fluorescent lamps are horizontally mounted in the main body for a cylindrical illuminating implement; the reflecting efficiency is increased by setting a first reflecting plate thereon and mounting a second reflecting plate with a plurality of supporting members on an open part of the lower portion of the main body; a plurality of sliding holes are provided through the side wall of the main body and fixing members are placed in the sliding holes to fixedly clamp the main body fixed when the main body is inserted into a recess at any position on a ceiling (or a boarded ceiling).

BACKGROUND OF THE INVENTION

In a conventional recessed illuminating apparatus shown in FIG. 8, a supporting member 3 is fixed on a peripheral portion of the open portion 2 of a main body of a cylindrical illuminating apparatus, and a fixed piece 4 is inwardly bent at the lower end of both sides of the supporting member 3 to form a sliding recess which receives a fixed rod 6.

In the conventional recessed illuminating apparatus, the sliding recess 5, which is formed by bending inwardly the fixed pieces 4 on the lower ends of both sides for the supporting member 3, receives the fixed rod 6 mounted in the ceiling 7.

The resulting apparatus is pushed on the fixed position in the ceiling and fixed and then the apparatus is finally mounted in the ceiling.

Accordingly, the above apparatus has not only reduced working efficiency, but also has a drawback of producing easy fatigue of eyes by having vertical fluorescent lamps.

Various arrangements for mounting light fixtures in ceilings utilizing plaster frames are known in the prior art.

An example of such a prior art arrangement is illustrated in U.S. Pat. No. 4,293,895 (Kristofek, issued on Oct. 6, 1981 and showing a mounting arrangement for a recessed light fixture housing).

This patent discloses an arrangement for mounting an enclosed lighter fixture housing in a planar support member, for example a ceiling or wall, in a recessed fashion with respect thereto using a plaster frame or a like support member.

This patent does not suggest and disclose a wave-shaped reflecting plate having a horizontal arrangement of a fluorescent lamp and a narrow upward and large downward reflecting plate.

Further, a ceiling recessed light fixture is illustrated in Japanese Patent Publication No. 1988-29362 (Published on Jun. 13, 1988 by Noboru Kitamura for a "ceiling recessed light fixture").

This Japanese patent publication discloses a vertical arrangement of a fluorescent lamp and support arms.

This patent publication does not suggest and disclose a wave-shaped reflecting plate having a horizontal arrangement of a fluorescent lamp and a large downward and narrow upward reflecting plate supported by the resilient force of the resilient piece for the supporting member.

Another example of such a prior art arrangement is illustrated in Japanese Patent Publication No. 1989-43964 (Published on Sep. 25, 1989 by Masaya Kazuta for a "recessed light fixture").

This patent publication discloses a longitudinal slit in a side wall and the fixture body formed continuously clamped in a hole.

However, this patent publication does not disclose and suggest a wave-shaped reflecting plate having a horizontal arrangement of a fluorescent lamp and a narrow upward and large downward reflecting plate.

Accordingly, a primary object of the present invention is to provide a recessed illuminating apparatus having a body, a fixing member, a supporting member, a wave-shaped first reflecting plate, and a large downward and narrow upward second reflecting plate.

Another object of the present invention is to provide an improved reflecting efficiency of the recessed illuminating apparatus by providing a waveshaped first reflecting plate having a horizontal arrangement of an elongate lamp and a narrow downward and large upward second reflecting plate.

Still another object of the present invention is to provide the improved workability of the recessed illuminating apparatus when the body is inserted into a recessed hole in a ceiling.

SUMMARY OF THE INVENTION

A recessed illuminating apparatus according to the present invention includes a body, a fixing member, a supporting member, a wave-shaped first reflecting plate and a large downward and narrow upward second reflecting plate.

The body is characterized in that a flange is mounted on the lower end of the body, a plurality of sliding holes are formed in a side wall, a rectangular inserting hole is formed in the upper end of the body to be communicated with the sliding holes, a plurality of inserting holes are alternately formed with the sliding holes from the inner side of the portion joining the flange with the side wall, an open hole is formed on the upper end of the side wall, and an elongate light source is horizontally supported by a member on the opposite side of the body from the open hole.

A fixing member has an inserting piece inserted into a rectangular inserting hole and positioned in the body, has a guide piece and a fastening screw inserted with a washer from the inner side of the body clampingly engages a fastening hole formed in the center of the guide piece, a connecting piece connected with the guide piece on the inserting piece and at the same time movingly formed, and a resilient piece bent to extend at an incline from the lower end of the guide piece is adapted to be pressed against the ceiling.

A supporting member has a U-shaped inserting portion and a resilient piece is bent to extend at an incline from the upper end of one side on the U-shaped inserting portion, a fixing sharp piece being formed by forming inclined cut-out portions on both sides of another side of the U-shaped inserting portion, wherein the U-shaped inserting portion is fixedly inserted.

A wave-shaped first reflecting plate is mounted at the upper end of the inner side of the body.

A large downward and narrow upward second reflecting plate is supported by the resilient force of the resilient piece of the supporting member when inserted into the inner side of the open portion on the lower end of the body.

BRIEF DESCRIPTION OF THE DRAWINGS

For a fuller understanding of the nature of the present invention, reference should be had to the following detailed description taken in connection with the accompanying drawings, in which.

DETAILED DESCRIPTION

Figure 1:
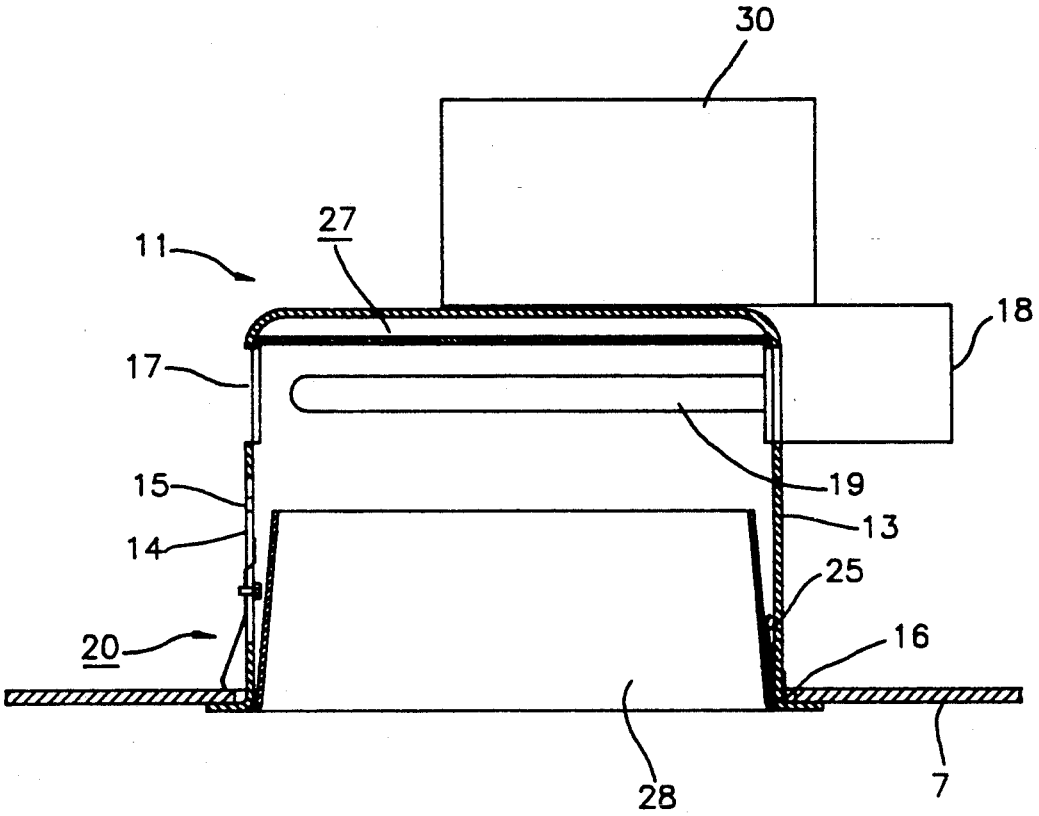
FIG. 1 is a cross-sectional view showing an installed condition of a recessed illuminating apparatus according to the present invention.
Figure 2:
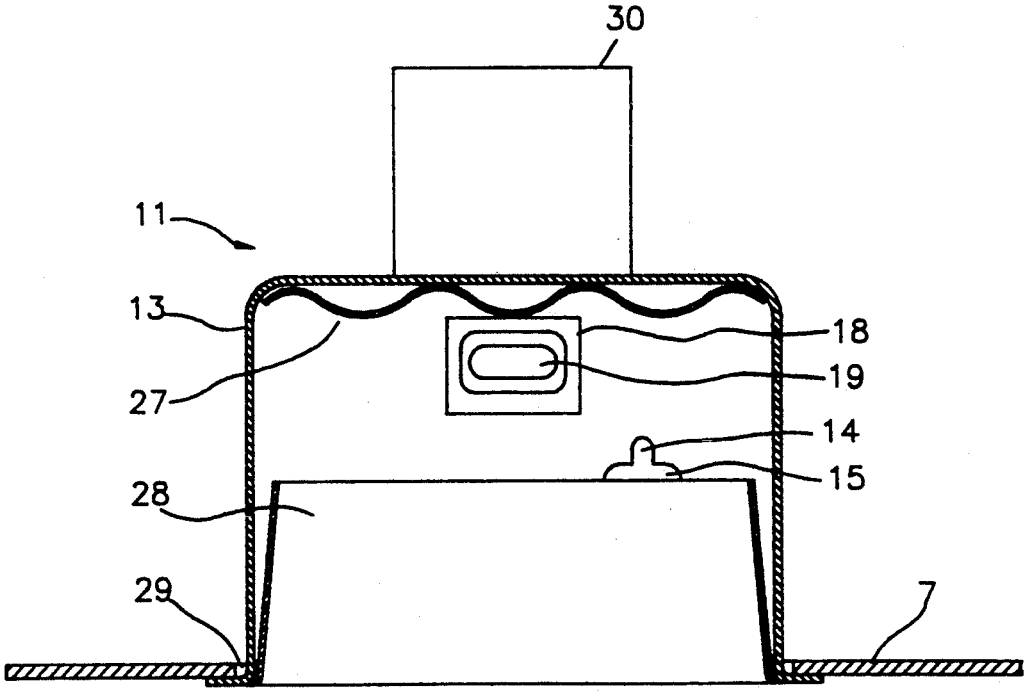
FIG. 2 is a longitudinal sectional view of Figure 1.
Figure 3:
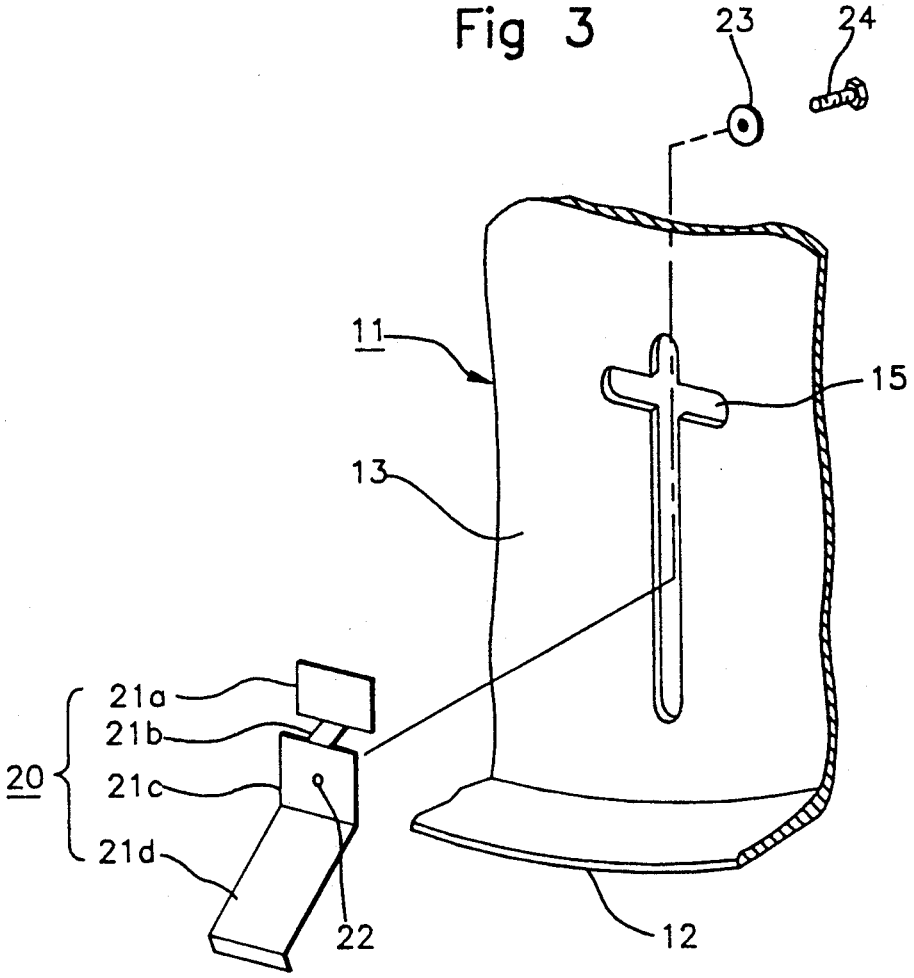
FIG. 3 is an exploded perspective view showing a fixing member and part of a body of the apparatus of the invention.

With reference to FIGS. 1 to 7, for ease of understanding, the same reference numerals have been used to denote like parts.

Reference numeral 11 denotes a cylindrical body, and the body 11 has a flange 12 at the lower end thereof, and a plurality of vertical sliding holes or slots 14 are formed in a wall 13 of the body 11.

A plurality of inserted holes 16 (FIG. 5) are formed through a portion joining the flange 12 with the side wall 13, so as to alternate circumferentially with the sliding holes 14.

Further, an open hole 17 is formed in the upper end of the side wall 13, and a fluorescent lamp fixing member 18 is mounted on the opposite side of the body from the open hole 17 so that horizontal installation of the fluorescent lamp is easy.

Reference numeral 20 denotes a fixing member, which includes an inserting piece 21*a*, a connecting piece 21*b*, a guide piece 21*c* and a resilient piece 21*d*.

The inserting piece 21*a* can be inserted through a rectangular inserting hole or slot 15 communicating with the sliding hole 14 in the side wall 13 of the body 11, so that it is disposed within the body 11.

The guide piece 21*c* connected to the inserting piece 21*a* by the connecting piece 21*b* is disposed on the outer side of the body 11, and is clamped to the body 11 by a fastening screw 24 and washer 23 disposed inside of the body 11, with the screw engaging a fastening hole 22 formed in the center of the guide piece 21*c*, which at the same time allows easy sliding displacement (movement) of member 20 through loosening of the screw.

The resilient piece 21*d*, which is bent to extend at an incline from the lower end of the guide piece 21*c*, is adapted to be pressed against the rear surface of a ceiling 7.

Reference numeral 25 denotes a supporting member, several of which are each inserted into a respective one of the inserting holes 16 formed in the portion of body 11 joining the side wall 13 and the flange 12 at the lower end of the body 11. The supporting member 25 is bent so that a resilient piece 26*b*, extends at an incline from an upper end of one side of a U-shaped inserting portion 26*a*, and on the upper end of the other side of the U-shaped portion 26*a*, a cut-out portion or slit 26*c* is slantly formed on both sides so that a fixing sharp piece 26*d* is formed. The sharp piece 26*d* is adapted to fixedly grip the side wall 13 of the body 11.

Reference numeral 27 denotes a first reflecting plate supported at the upper end of the inside of the body 11, and the plate 27 is formed with a wave shape.

Reference numeral 28 denotes a second reflecting plate which is large downward and narrow upward, and in particular is a frustoconical sleeve. The second reflecting plate 28 is inserted into the open portion 2 at the lower end of the body 11. The second plate 28 is supported there by the resilient forces of the resilient pieces 26*b* of the supporting members 25, inserted into the inserting holes 16 in the portion of body 11 joining the side wall 13 with the flange 12.

Reference numeral 29 denotes a recessed hole formed in the ceiling 7. The diameter of the hole 29 is smaller than the outer diameter of the flange 12 of the body 11 and is larger than the outer diameter of the side wall 13 of body 11. Reference numeral 30 (FIG. 7) denotes a stabilizing apparatus fixed on the upper portion of the body 11.

The operation of the above-described apparatus according to the invention will be described in greater detail below.

Firstly, the wave-shaped first reflecting plate 27 is attached to the upper portion of the inside of the body 11, and the fluorescent lamp 19 below the first reflecting plate 27 is horizontally inserted through the open hole 17 of the side wall 13 of the body 11 and is fixed on the fixing member 18.

Figure 4:
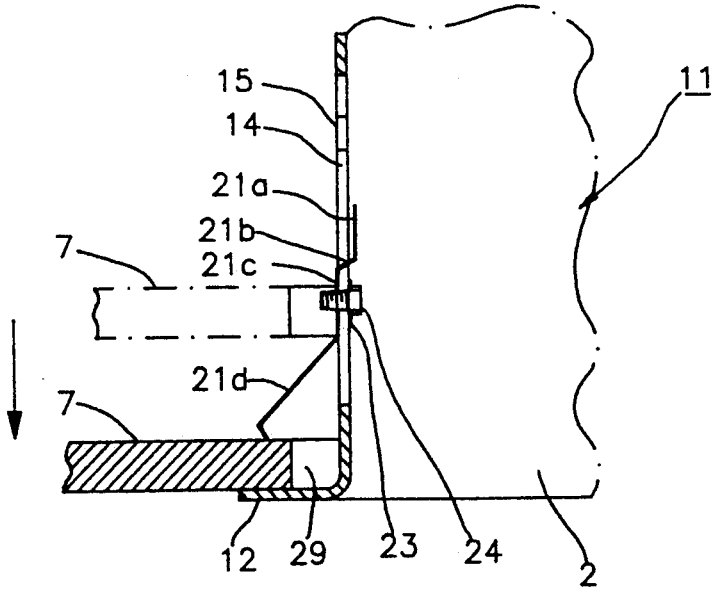
FIG. 4 is a cross-sectional view showing an installed condition of the structure of FIG. 3.

Further, the inserting piece 21*a* of each fixing member 20 is inserted into a respective rectangular inserting hole 15 communicating with a plurality of sliding holes 14 formed in the side wall 13 of the body 11 until it is positioned on the inner side of the body 11 and the connecting piece 21*b* is in the hole 14. The guide piece 21*c* having the fastening hole 22 is disposed outside the side wall 13, and the fixing member 20 is positioned along hole 14 in accord with the thickness of the ceiling 7. Then the fastening screw 24 with the washer 23 is inserted into the fastening hole 22 of the guide piece 21*c* from the inner side of the body 11, and clampingly fixes the member 20 with respect to the sliding hole 14 of the body 11, as shown in FIG. 4.

Figure 5:
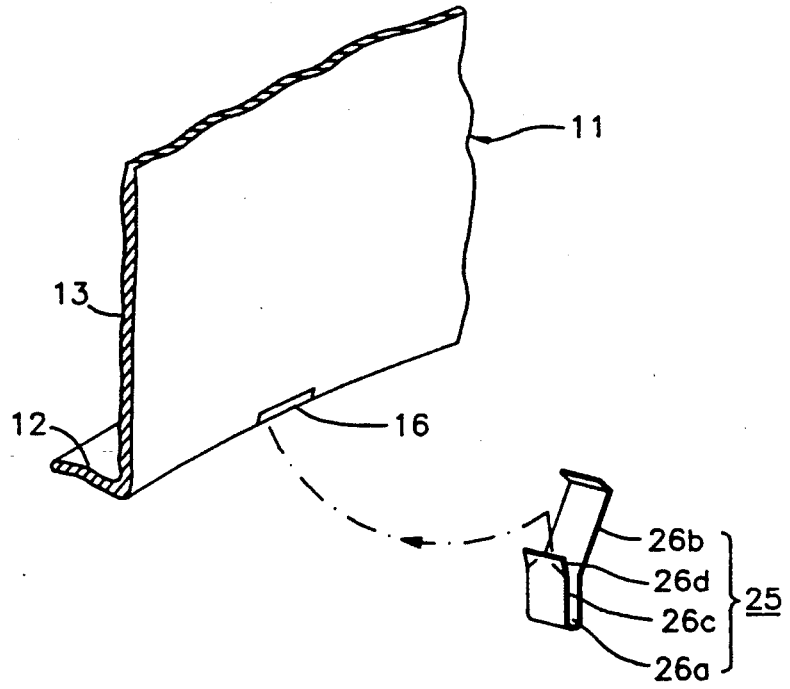
FIG. 5 is an exploded perspective view showing a supporting member and part of the body of the inventive apparatus.

Further, as shown in the FIG. 5, one side of the U-shaped inserting portion 26*a* of each supporting member 25 is inserted into a respective inserting hole 16 formed through the portion of body 11 joining the flange 12 with the side wall 13, and the fixing sharp pieces 26*d* formed by the cut-out portions 25*c* engage the outer side of the side wall 13 to clampingly fix the member 25 on the side wall 13.

Figure 6:
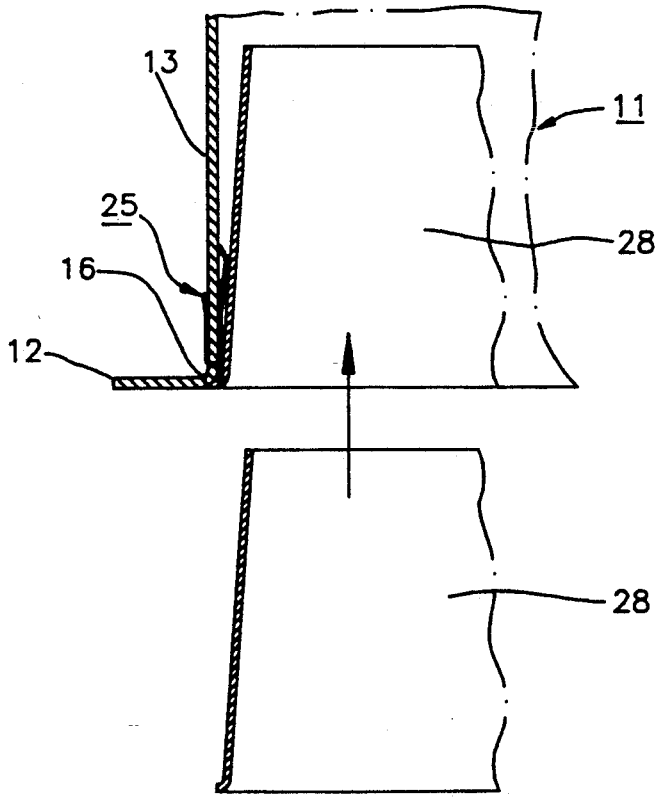
FIG. 6 is a sectional view showing an installed condition of the structure of FIG. 5.
Figure 7:
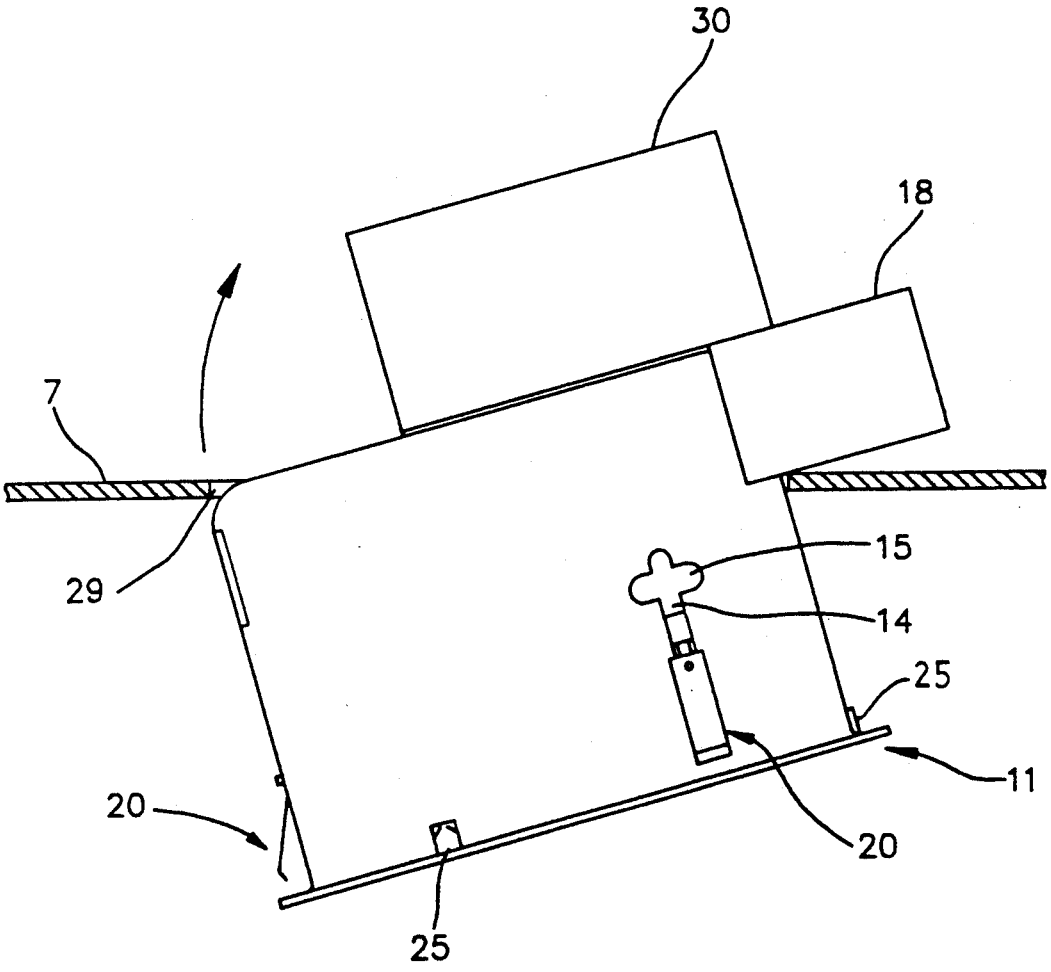
FIG. 7 is a side view showing an installation step for the inventive apparatus.
Figure 8:
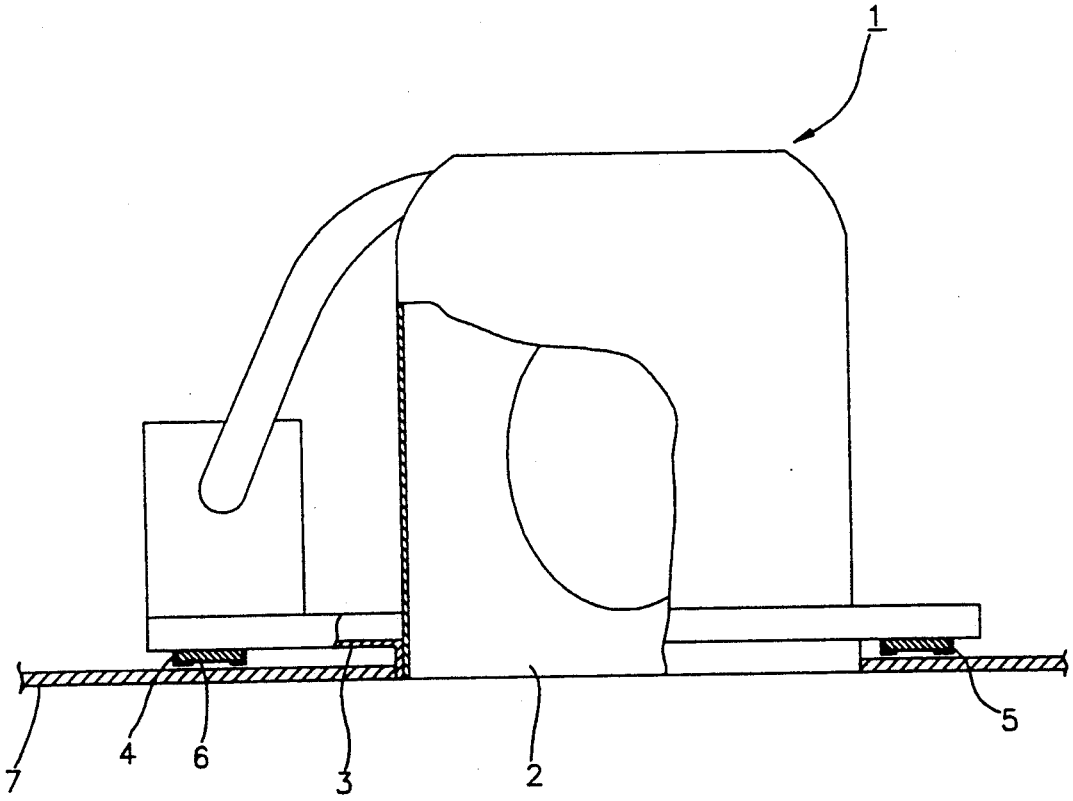
FIG. 8 is a partially broken away sectional view showing a conventional recessed illuminating apparatus.

As shown in the FIG. 6, the large downward and narrow upward frustoconical second reflecting plate 28 is inserted into the open portion 2 at the lower end of the body 11 in the arrow direction (FIG. 6) and engages the resilient pieces 26*d* in the inside of the body 11, whereby removal of the second reflecting plate 28 is yieldably resisted by friction with and the resilience of the resilient pieces 26*b* of the plurality of supporting members 25.

When the recessed illuminating apparatus (assembled as described above) is to be installed in a recessed manner in the ceiling 7, the diameter of the recessed hole 29 is formed smaller than the outer diameter of the flange 12 of the body 11, and larger than the outer diameter of the side wall 13. The recessed hole 29 is formed in this way, and then the stabilizing apparatus 30 and the light source fixing member 18, which are projectingly mounted on the upper end and the outer peripheral surface of body 11, are first inserted into the recessed hole 29 in the ceiling 7 as shown in the FIG. 7, and then the body 11 is rotated in the arrow direction.

After rotation, the flange 12 of the body 11 is horizontally aligned with the ceiling 7, and then the body 11 is pushed upward in the vertical direction relative to the ceiling 7. In this way, the body 11 is properly positioned in the recessed hole 29 of the ceiling 7 as shown in the FIG. 1.

At this time, as shown in FIG. 4, on both sides of the recessed hole 29 having the diameter smaller than the outer diameter of the flange 12 of the body 11 and larger than the outer diameter of the side wall 13 of the body 11, the resilient pieces 21*d* of the fixing members 20 which were fixed in the sliding holes 14 formed on the side wall 13 of the body 11 and which flexed to pass through hole 29, upon engagement of the surface of the ceiling 7 by the upper surface of the flange 12 of the body 11 return by their inherent resilient forces to their original positions and thus engage the rear surface of the ceiling 7. Accordingly, as shown in FIG. 4, the body 11 is clampingly fixed on the ceiling 7 by the resilient pieces 21*d* of the fixing members 20. By such operation, the working efficiency is improved.

As described above, in the apparatus for the present invention, the fluorescent lamp in the body is horizontally arranged, the wave-shaped first reflecting plate is provided, and at the same time the large downward and narrow upward frustoconical second reflecting plate is inserted into and retained by the supporting members in the open portion of the lower end of the body, whereby the reflecting efficiency can be increased.

Further, a plurality of sliding holes are formed in the side wall of the body and, after the body is inserted into the ceiling, the resilient pieces of the fixing members movingly fixed in the sliding holes clampingly press against the rear surface of the ceiling, whereby even the heavy recessed illuminating apparatus produces no deformation of the fixing member and the body is not removed from the ceiling, so the workability is effectively improved.

The fixing member secured in the sliding hole is releasably fixed to allow adjustment up and down, and the position of the fixing member can thus be freely fixed to reflect the thickness of the ceiling.

While the subject invention has been described in the context of the recessed illuminating apparatus, it will be apparent to anyone skilled in the art that this invention has equal application to other forms of the apparatus.

Furthermore, while the example of this invention has been advanced in the drawings and accompanying description, it will be apparent that changes and modifications can be made to the apparatus as specifically illustrated, without departing from the spirit or scope of this invention.

The embodiments of the invention in which an exclusive property or privilege is claimed are defined as follows:

1. A recessed illuminating apparatus, comprising:

a body having a flange flared from a lower end of the body, a plurality of sliding holes being formed in a side wall of the body, a plurality of rectangular first inserting holes formed in an upper portion of the body to each communicate with a respective one of the sliding holes, a plurality of second inserting holes formed circumferentially alternately with said sliding holes through a portion of the body joining said flange with the side wall, an open hole formed through the upper end portion of the side wall, and an elongate light source horizontally supported by a light source fixing member disposed on the opposite side of the body from the open hole;

a plurality of further fixing members each having an inserting piece insertable through a respective said rectangular first inserting hole and disposed within the body, a guide piece connected by a connecting piece to the inserting piece and having a hole into which a fastening screw with a washer is inserted from an inner side of the body to releasably clamp the further fixing member, and a resilient piece extending at an incline from a lower end of the guide piece and engageable with a top surface of a ceiling member;

a plurality of supporting members which each have a U-shaped inserting portion, a resilient piece extending at an incline from the upper end of one side of the U-shaped inserting portion, and a fixing sharp piece formed by slanted cut-out portions on both sides of the other side of the U-shaped inserting portion, wherein the U-shaped inserting portion has one side inserted through a respective said second inserting hole and is fixedly held to the body by the sharp piece;

a wave-shaped first reflecting plate supported at the upper end of the inside of the body; and a large downward and narrow upward second reflecting plate which is supporting by the resilient force of the resilient pieces of the supporting members within the open portion in the lower end of the body.

2. An apparatus according to claim 1, wherein said wave-shaped first reflecting plate has a plurality of spaced waves which extend approximately parallel to each other and to said elongate light source.

3. An apparatus of claim 1, wherein said second reflecting plate is annular and has an upwardly converging frustoconical shape.

4. An apparatus, comprising: a body having an opening extending thereinto from a lower end thereof; an elongate fluorescent light-emitting element supported within said opening in said body so as to extend approximately horizontally; a fist reflecting member supported within said opening through said body above said light-emitting element and having a downwardly facing reflection surface with a plurality of spaced and approximately a parallel waves; a second reflecting member supported within said opening inn said body below said light-emitting element, said second reflecting member being annular and having an upwardly converging frustoconical shape; and a plurality of supporting clips which are supported at spaced locations on said body and which each have a resilient portion engaging said second reflecting member, said resilient portions yieldably resisting downward movement of said second reflecting member relative to said body; wherein said body has an approximately vertically extending annular side wall, has an approximately radially outwardly extending flange at a lower end of said side wall, and has therethrough at the intersection of said side wall and said flange a plurality of peripherally spaced insertion openings, each of said supporting clips having a U-shaped inserting portion with first and second spaced sides, said resilient portion extending at an incline from an outer end of said first side of the supporting clip and the second side of each supporting clip having slanted cuts adjacent an outer end thereof which define fixing portions, said second side of each said supporting clip being inserted through a respective said inserting hole in said body so that said fixing portions thereon engage said body to resist removal of the supporting clip therefrom and said resilient portions thereof are disposed within said body and are resiliently urged against said second reflecting member.

5. An apparatus according to claim 4, wherein said waves of said reflecting surface on said first reflecting member extend approximately parallel to each other and to said light-emitting element.

6. An apparatus according to claim 4 wherein said body is disposed within an opening through a ceiling member so that an upper side of said flange is disposed against an underside of said ceiling member, and including a plurality of fixing clips which are each secured to said body and each engage an upper side of said ceiling member to resist removal of said body from said opening in said ceiling member.

7. An apparatus, comprising: a body having an opening extending thereinto from a lower end thereof; an elongate fluorescent light-emitting element supported within said opening in said body so as to extend approximately horizontally; a first reflecting member supported within said opening through said body above said light-emitting element and having a downwardly facing reflection surface with a plurality of spaced and approximately parallel waves; and a second reflecting member supported within said opening in said body below said light-emitting element, said second reflecting member being annular and having an upwardly converging frustoconical shape; wherein said body includes an annular side wall having a flange extending radially outwardly from a lower end thereof; wherein said body is disposed within an opening through a ceiling member so that an upper side of said flange is disposed against an underside of said ceiling member; including a plurality of fixing clips which are each secured to said body and each engage an upper side of said ceiling member to resist removal of said body from said opening in said ceiling member; wherein said body has a plurality of vertically extending slots therein and has a plurality of horizontally extending sliding holes which each intersect a respective one of said slots near an upper end thereof; wherein each said fixing member has an inserting portion which can be inserted through said horizontal slot, a guide portion disposed on an outer side of said side wall, a connecting portion extending between said inserting portion and said guide portion, and a resilient portion extending outwardly from an end of said guide portion remote from said inserting portion; and including a plurality of screws which each have a head disposed within said opening in said body nd a threaded shank extending through a respective said sliding hole and threadedly engaging an opening provided in said guide portion of a respective said fixing member.

8. An apparatus according to claim 7, including a plurality of supporting clips which are supported at spaced locations on said body and which each have a resilient portion engaging said second reflecting member, said resilient portions yieldably resisting downward movement of said second reflecting member relative to said body.

9. An apparatus according to claim 7, wherein said light-emitting element is removably supported within said body, and wherein said body includes an annular side wall having therethrough an opening which is aligned with a centerline of said light-emitting element in order to facilitate insertion and removal of said light-emitting element with respect to said body.

* * * * *

UNITED STATES PATENT AND TRADEMARK OFFICE

CERTIFICATE OF CORRECTION

PATENT NO. : 5 264 994

DATED : November 23, 1993

INVENTOR(S) : Yoong Jae CHOI

It is certified that error appears in the above-identified patent and that said Letters Patent is hereby corrected as shown below:

Column 6, line 50; change "fist" to ---first---.
line 54; delete "a" (first occurrence).
line 55; change "inn" to ---in---.
Column 8, line 20; change "nd" to ---and---.

Signed and Sealed this

Twenty-sixth Day of April, 1994

*Attest:*

*Attesting Officer*

BRUCE LEHMAN

*Commissioner of Patents and Trademarks*